United States Patent [19]

Tönsmann

[11] Patent Number: 4,638,613

[45] Date of Patent: Jan. 27, 1987

[54] METAL-GLASS STRUCTURE FOR A FRONT WALL OR A ROOF

[75] Inventor: Armin Tönsmann, Bielefeld, Fed. Rep. of Germany

[73] Assignee: Schüco Heinz Schürmann GmbH & Co., Bielefeld, Fed. Rep. of Germany

[21] Appl. No.: 738,023

[22] Filed: May 24, 1985

[30] Foreign Application Priority Data

May 25, 1984 [DE] Fed. Rep. of Germany ..... 3419538
Jul. 26, 1984 [DE] Fed. Rep. of Germany ..... 3427511

[51] Int. Cl.[4] ..... E04B 2/88
[52] U.S. Cl. ..... 52/235; 52/200
[58] Field of Search ..... 52/200, 235, 403

[56] References Cited

U.S. PATENT DOCUMENTS 3,844,087 10/1974 Schultz et al. ..... 52/200
3,978,629 9/1976 Echols ..... 52/235
4,121,396 10/1978 Oogami et al. ..... 52/235
4,251,964 2/1981 Francis ..... 52/235 X
4,455,798 6/1984 Tsakiris ..... 52/200

*Primary Examiner*—J. Karl Bell
*Attorney, Agent, or Firm*—Michael J. Striker

[57] ABSTRACT

In a glass-metal structure for a front wall or a roof of a building, comprising a metal framework and glass panels, the framework is formed of hollow elongated main frame sections and hollow elongated crossbar frame sections extending transversally of the main frame sections. Cover plates overlapping the edges of the glass panels are screwed by bolts to the frame sections. Each frame section and each cover plate is provided with anchoring grooves receiving sealing strips. Each frame section has gutters for condensed water and grooves for percolating waters. Each crossbar frame section has a main hollow chamber and an additional hollow chamber formed between the gutters of the crossbar frame section.

16 Claims, 9 Drawing Figures

METAL-GLASS STRUCTURE FOR A FRONT WALL OR A ROOF

BACKGROUND OF THE INVENTION

The present invention relates to a metal-glass structure for a front wall or a roof of a building.

The metal-glass structure of a front wall or a roof of the type under consideration is comprised of a metal framework, the flats of which are covered with glass panels. The metal framework includes a plurality of main frame sections or profiles at the side of the building and a plurality of crossbar frame sections or profiles extended transversely of the main profiles and covered at their outer sides with cover frame sections which are connected by bolts to the main frame sections or the crossbar frame sections. The main frame sections, crossbar frame sections and cover frame sections have anchoring grooves for sealing strips supported at the edges of the glass panels. The main and crossbar frame sections are also provided with gutters for condensed water and grooves for percolating waters. The main frame sections are normally hollow profiles.

A conventional front wall-or-roof structure is depicted in FIG. 1. The crossbar frame section of the framework of this structure has only one hollow chamber, the upper wall of which forms two grooves for collecting percolating water. Percolating water is collected between the edges of the glass panels and the sealing strips provided in the cover frame sections and should be drained off therefrom through the grooves formed in the main frame sections. In order to provide a smooth transition between the percolating water-receiving grooves of the crossbar frame sections and the grooves of the main frame sections the latter should be coped in the region of the butt between the main frame section and the crossbar section. Furthermore the shape of the crossbar frame sections must be adjusted to the shape of the main frame sections, and the upper walls of the hollow chambers of the crossbar frame sections should extend up to the region of the corresponding water-receiving grooves of the main frame sections. If clogging takes place in the grooves of the main profiles percolating waters flow into the hollow chambers of the crossbar profiles. However, leakage can occur at the connections of the crossbar profiles.

Main frame sections or profiles of conventional front wall or roof structures have gutters for condensed water, which is collected at the edges of the glass panels and flows into the gutters. The bottom wall of the hollow chamber of each crossbar frame section extends in the region of such a gutter of the main frame section so that in case of clogging in the gutter of the main frame section condensed water can flow into the hollow chamber of the crossbar frame section.

SUMMARY OF THE INVENTION

It is an object of the present invention to provide an improved front wall or a roof structure.

It is another object of this invention to provide a front wall or a roof structure in which, for discharging percolating waters from the grooves of the crossbar frame sections into the grooves of the main frame sections in the regions of the butts therebetween a coping of the walls of the grooves of the main frame sections is avoided and, in case of obstruction in a drain water system for condensed waters and percolating waters, the penetration of waters into the hollow chambers of the crossbar frame sections is avoided.

These and other objects of the invention are attained by a metal-glass structure for a front wall or a roof, comprising a metal framework having flats covered with glass panels, said framework including a plurality of main frame sections at a building side; a plurality of crossbar frame sections extending transversely of said main frame sections; a plurality of cover profiles screwed to said main and crossbar frame sections and extending over edges of said glass panels, said main frame sections, said crossbar frame sections and said cover profiles having anchoring grooves; and sealing strips received in said anchoring grooves and supported on the edges of the glass panels, said main and crossbar frame sections each enclosing a hollow chamber and being provided with gutters for condensed water and grooves for percolating water, each groove for percolating water in each crossbar frame section having a bottom wall which extends up to an upper edge of a respective groove for percolating water of an adjacent main frame section and is supported against said upper edge, each crossbar frame section having a main hollow chamber and an additional hollow chamber above said main chamber, said additional chamber being positioned between two gutters for condensed water and having a bottom wall being flush with bottom walls of said gutters, the bottom wall of each additional hollow chamber and the bottom walls of said two gutters of each crossbar frame section being supported on an upper longitudinal edge of a respective gutter for condensed water of the adjacent main frame section.

The construction of the front wall or the roof according to the present invention ensures that the separation of the draining of condensed water from the draining of percolating water is such that main frame sections should be not provided with coping elements. It is further ensured that in case of stagnation of water in the gutters or water-receiving grooves no water would drain off into the hollow chambers of the main or crossbar frame sections, and a waterproof structure at the connections of the main and crossbar frame sections with other structural components of the front wall or the roof would be warranted.

Each main frame section may have two longitudinal grooves for percolating water, said longitudinal grooves being defined by outer profiled wall portions which form the anchoring grooves for said sealing strips, each crossbar frame section having at least two anchoring grooves for the sealing strips, said two anchoring grooves having the same height as that of said grooves for percolating water, said anchoring grooves for the sealing strips having walls which in a region of overlapping are supported on the anchoring grooves of the adjacent main frame section.

The gutters for condensed water of each main frame section may each have a bottom wall which is flush with a bottom wall of each groove for percolating water of said main frame section, the bottom walls of said gutters and the bottom walls of said grooves forming an upper wall of a hollow chamber of each main frame section.

Each main frame section may be formed with a central web extended upwardly from the hollow chamber thereof, said web being formed with a threaded opening and defining said two grooves for percolating water.

Each crossbar frame section may be formed with a central profiled portion extended upwardly from said additional hollow chamber and being formed with a threaded opening, said central portion defining said two grooves for percolating water.

The structure may further include profiled strips of plastics, each extended between each two adjacent glass panels over the entire width of the glass panel, each profiled strip having a fastening foot projection received in a respective threaded opening.

The foot projection may have locking tongues engaged in a respective threaded opening.

A longitudinal gap for water may be formed between an end face of a cover profile screwed to a respective crossbar frame section and an end face of a cover profile screwed to a respective main frame section.

The structure may further include supporting strips or foils each overlapping the edges of adjacent glass panels and being supported between the sealing strips received in the anchoring grooves of each cover profile and the edges of adjacent glass panel, said foils being each coated, at a side facing an edge of a respective glass panel, with a sealing mass and having a length corresponding to that of a respective cover profile.

Two supporting foils, superposed one another, may be positioned in the region of intersecting of the cover profiles, said supporting foils being each coated with a sealing mass at a side thereof facing a respective glass panel.

In the region of said gap, an opening in the end face of the cover profile, screwed to a respective crossbar frame section, may be closed with a sealing mass.

Angular shaped sealing strips may be provided in each corner region between adjacent frame sections, the sealing strips received in said anchoring grooves being connected with said angular shaped sealing strips.

Each of the outer profiled portions defining the anchoring groove in said main frame section may include a crosspiece extended upwardly from the hollow chamber of the main frame section, each outer profiled portion being inclined to said crosspiece, each crossbar frame section being also inclined to an adjacent main frame section, the angle of the inclination of the profiled portion to said crosspiece being equal to the angle of inclination of each crossbar frame section to the adjacent main frame section. This embodiment ensures that in case of the inclined crossbar frame sections to the main frame sections the wall of each groove for condensed water of the crossbar frame section can extend up to the upper edge of a respective groove of the main frame section and be supproted on said upper edge. In other words, the bottom walls of the grooves of the crossbar frame section are inclined at the same angle as the respective anchoring grooves of the main frame section. Thus a specific additional sealing in the region of the butt between these sections is no longer necessary.

By inclined profiled portions it is further ensured that the same sealing strips can be used with inclined crossbar frame sections as with those extended at right angles to the main frame sections.

A transition zone may be provided between each crosspiece and a respective profiled portion, an undercut being provided at said transition zone.

The cover profile may have a straight portion and angular end portions, said end portions being formed with the anchoring grooves receiving the sealing strips, said end portions being inclined to said straight portion at an angle which is equal to the angle of inclination of each crossbar frame section to the adjacent main frame section.

The straight portion of the cover profile may be provided with a central web at an underside thereof, and weakening grooves may be formed between said central web and said angular end portions at said underside.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
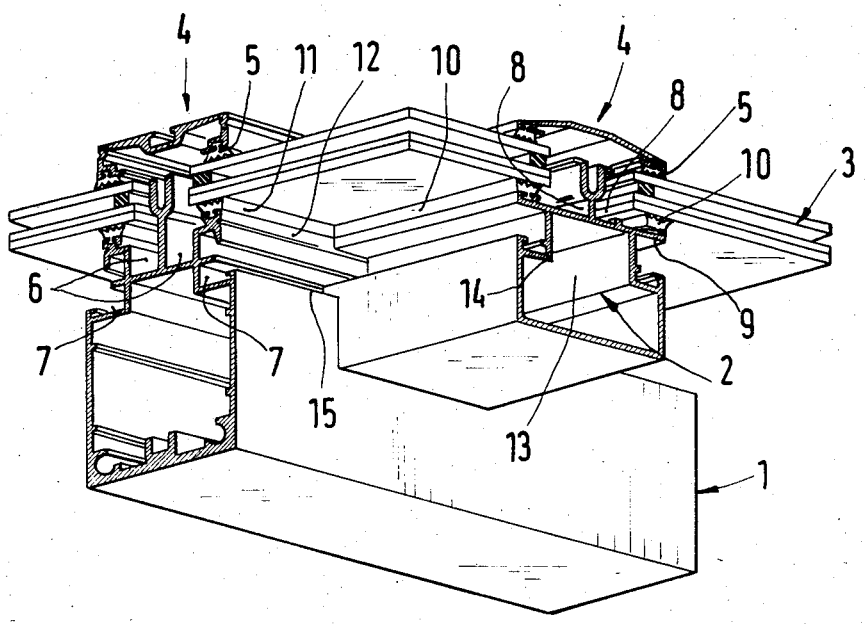
Fig. 1 PRIOR ART
FIG. 1 is a perspective view of the butt joint between a main profile and a crossbar profile of the framework for the front wall or roof to a prior art.

Referring now to the drawings in detail, FIG. 1 illustrates a butt joint between the main profile or frame and a crossbar profile or frame of the front wall or roof structure according to the prior art. The known metal-glass frame structure of the front wall or the roof includes a number of main profiles or frame sections 1 which form together with a number of crossbar profiles or frame sections 2 a framework, the flats of which are filled with insulating glass panels 3. At the outer side, facing away from the structure, the frame has a number of cover profiles or frame sections 4 which are screwed with the main frame sections 1 or crossbar frame sections 2 and are provided with anchoring grooves receiving sealing strips 5 which are supported at the edges of the glass panels.

Each main frame section 1 has grooves 6 for collecting percolating waters and gutters or channels 7 for collecting condensed water which forms on the underside of each glass panel and flows along the edges of the glass panel into gutters 7.

Each crossbar frame section 2 is provided with grooves 8 for percolating waters, grooves 8 being limited by anchoring grooves 9 and sealing strips 10 secured in the anchoring grooves.

The sealing strips 10' correspond in shape to sealing strips 11 of the main frame section 1 and are secured in anchoring grooves 12 which lie in the same plane extending parallel to the plane of the respective glass panel.

As seen in FIG. 1 a smooth connection between grooves 8 of the crossbar frame section and grooves 6 of the main frame section can be attained only then when the walls of the grooves of the main frame section are coped in the region of the butt. Percolating waters then can drain off from grooves 8 into grooves 6.

Each crossbar frame section 2 is provided with a hollow chamber 13, the gutters 14 for condensed water of which are supported on the upper longitudinal edges 15 of gutters 7. If condensed water is collected on gutters 7 it can drain off into the hollow chamber 13 of the crossbar frame section 2.

Referring now to the FIGS. 2–5 which illustrate the metal-glass-structure of the front wall or roof according to the present invention this structure is comprised of a plurality of main frame sections or profiles 16 extending parallel to each other and spaced from each other. Each main frame section 16 has a hollow chamber 17 having an upper wall 18 formed with elongated grooves 19 for percolating waters and elongated grooves or gutters 20 parallel to grooves 19 and adapted for collecting condensed waters. The bottom walls of grooves 19 and gutters 20 are flush with each other.

Grooves 19 for percolating waters of the main frame section are limited at the middle plane by a web 21 which in the exemplified embodiment is formed of one piece with a threaded recess or opening 22. Fastening bolts 23 of the cover frame section 24 are screwed into openings 22.

The outer longitudinal edges of grooves 19 of the main frame section 16, for collecting percolating waters, are formed by the walls of anchoring grooves 25 which receive sealing strips 26. Glass panels 27 are supported at the edges thereof on the sealing strips 26. Panels 27 are preferably made of insulating glass.

Crossbar frame sections or profiles 28, which together with the main frame sections 16 and respective cover frame sections 24 form a framework of the structure of this invention, are also hollow similarly to the main frame sections 16. The flats of crossbar frame sections 28 are filled with panes 27 or other filling panels. Each crossbar profile or frame section 28 includes an elongated main chamber 30 and an additional elongated smaller chamber 31 positioned above the main chamber and separated therefrom by a wall or web 38. Each crossbar frame section 28 is provided with elongated grooves 32 for percolating waters. In the exemplified embodiment illustrated in FIGS. 2 through 5 grooves 32 are limited by a frame portion constituting a threaded recess or opening 33 for receiving a fastening bolt and formed in the middle of the upper wall of crossbar frame section 28. Fastening bolts 34 are received in such threaded openings 33 for fastening cover frame section 29 to the crossbar frame section 28.

Grooves 32 are limited at their longitudinal edges by anchoring grooves 35 which receive sealing strips 36. As seen from FIG. 2 sealing strips 36, against which the edges of the glass panels or the edges of the filling plates are supported in the region of the crossbar frame section, have a smaller height than that of the sealing strips 26.

At the corner regions at which the sealing strips 26 and 36 abut against each other each corner is formed preferably by a shaped portion of rubber or plastics, this shaped portion having legs which are engaged, respectively in anchoring grooves 25 or 35. The sealing strips 26, 36 are connected with the legs of such shaped piece or portion by glue.

Figure 4:
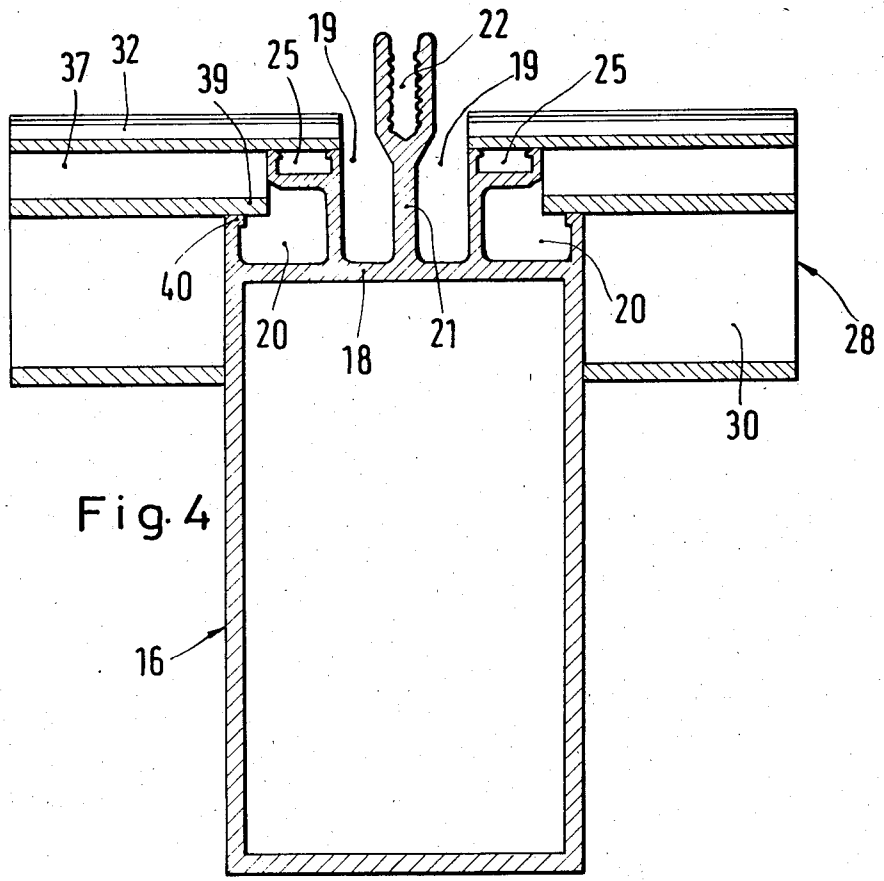
FIG. 4 is a vertical sectional view through the butt joint between two crossbar profiles and a single main profile.
Figure 3:
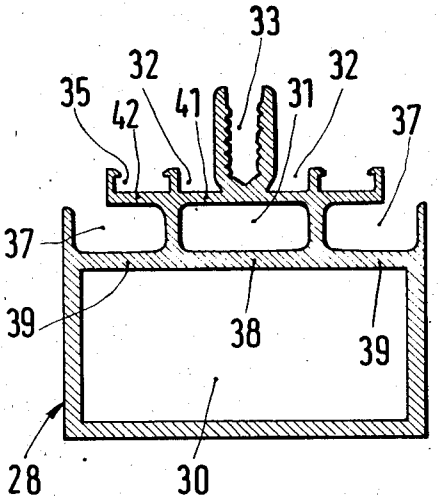
FIG. 3 is a cross-sectional view through the crossbar profile of the structure of FIG. 2.

As seen in FIG. 3 the additional chamber 31 of the crossbar frame section 28 is arranged between gutters 37 for collecting condensed water. The bottom wall 38 of the chamber 31 is flush with the bottom walls 39 of gutters 37. As seen in FIG. 4 the bottom walls 38 and 39 are supported on the upper longitudinal edges 40 of the gutters 20 of the main frame section 16, collecting condensed water as mentioned above. As also shown in FIG. 4 the crossbar frame section 28 should match at the region of the butt the main frame section 16 so that no coping or punch-out means would be required in the main frame sections.

The bottom wall 41 of the grooves 32 of the crossbar frame section, provided for percolating waters and bottom walls 42 of the anchoring grooves 35 are flush with each other and extend in the region of the butt up to the upper limiting edges of the grooves 19 of the main frame section. The bottom walls 41, 42 in the region of the butt are supported on the upper limiting edges of the anchoring grooves 25 for sealing strips 26.

Percolating water collected in grooves 32 of the crossbar frame section 28 can drain off from these grooves into grooves 19 while condensed water can flow from gutters 37 of the crossbar profile 28 down into the gutters 20 of the main profile 16. In case of stagnation in these gutters condensed water can flow down into additional chamber 31 of each crossbar frame section; no water, however flows into the main chamber 30 of the crossbar frame section.

Figure 2:
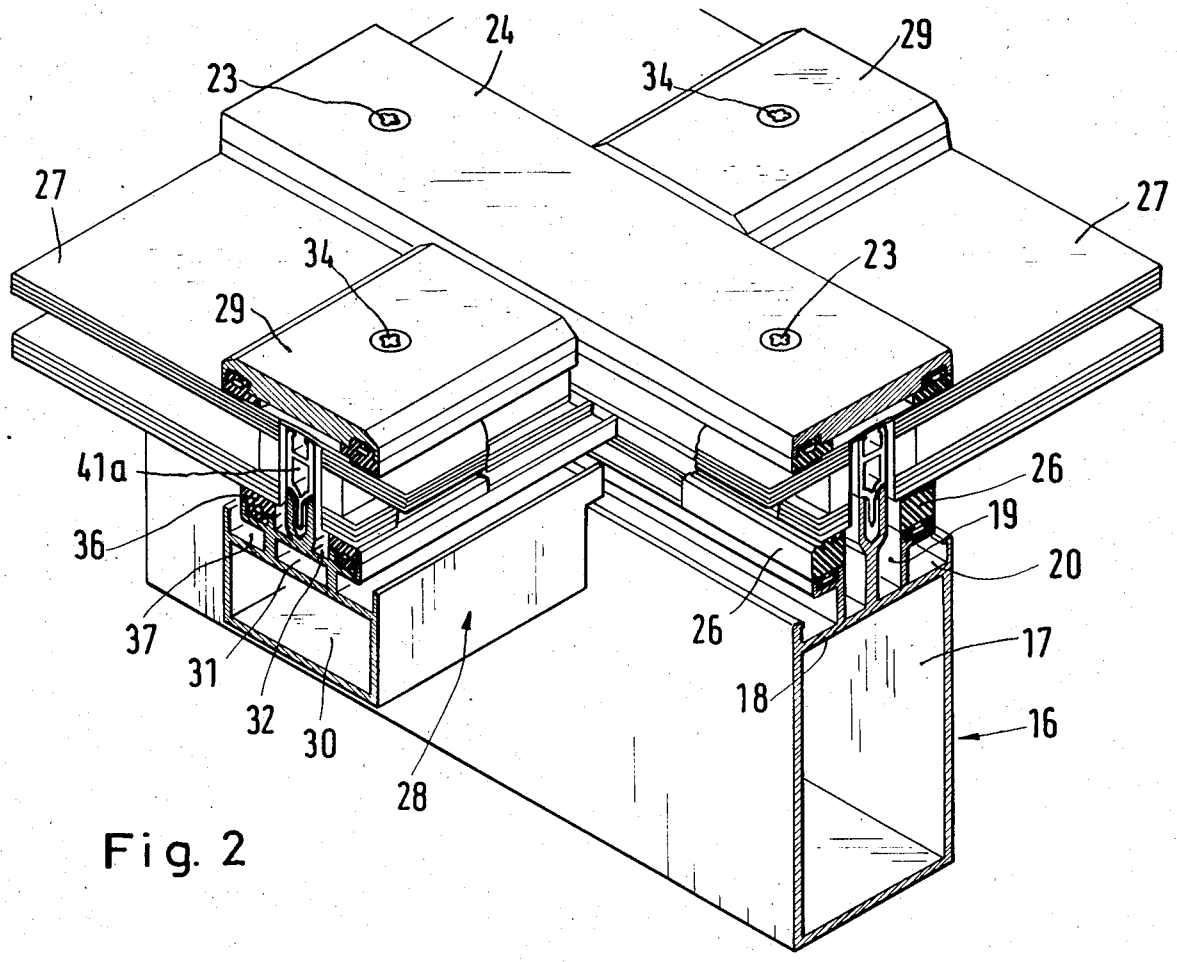
FIG. 2 a partial perspective view of the front wall or roof according to the invention.
Figure 5:
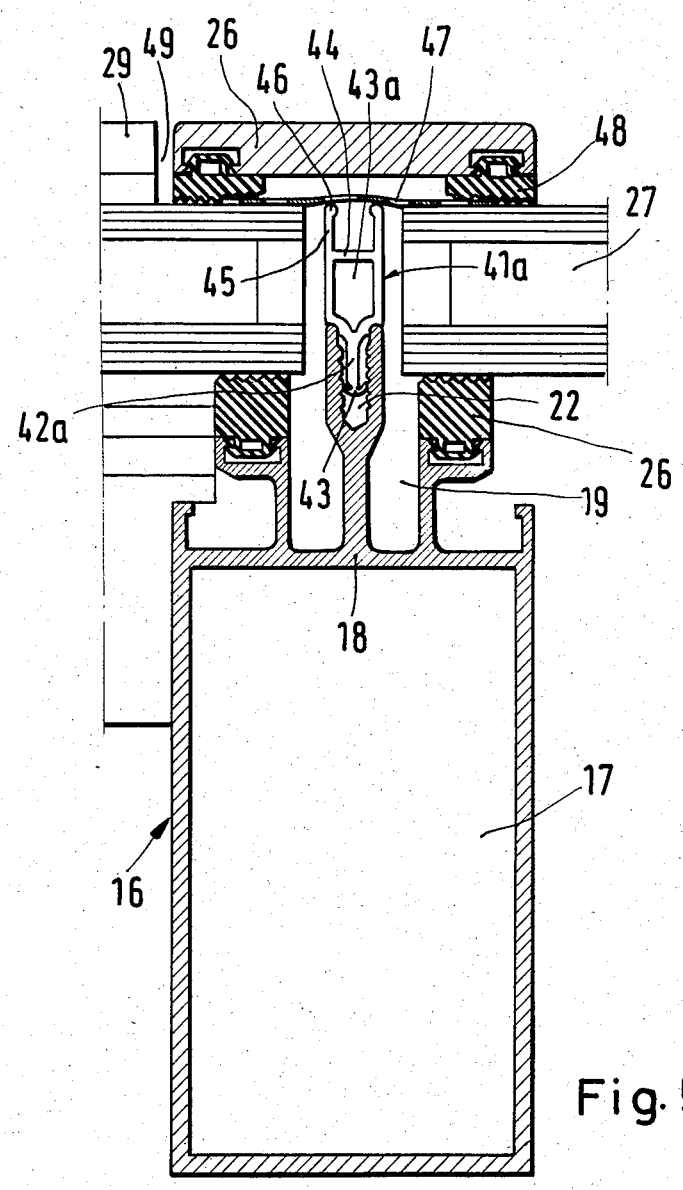
FIG. 5 vertical sectional view of the main profile provided with an insulating glass.

As seen from FIGS. 2 and 5 bolt-receiving recesses 22 and 33 extend beyond the thickness of the glass panel, and the insulating glass is provided over its entire thickness with a profiled or shaped strip **41*a* for increasing stability. Strip 41*a* is made of plastics and has a fastening projecting foot portion 42*a* which is provided with locking tongues 43 engaged with the inner thread of the threaded recess 22 or 33**.

The shaped strip **41*a* has an inner chamber 43*a* which is defined or limited by a web or cross-piece 44 at the side facing away from foot portion 43. Side strip portions 45, parallel to each other, extend upwardly from the cross-piece 44. Each strip portion 45 has at the free end thereof a bead 46. A supporting plate or foil 47 is supported on beads 46**. This plate is coated, at the side thereof facing the edge of the glass panel, with a sealing mass.

Padding pieces can be placed on the shaped strip **41*a*** for mounting individual glass panels.

The thin supporting plate or foil 47, which is coated with the sealing mass, serves the purpose of preventing further penetration of percolating waters. The supporting foil forms a strip, the width and the length of which correspond to those of the cover frame section 24 or 29. Sealing strips 48 mounted on the cover frame sections are supported on the supporting foil 47 and press the sealing mass with the aid of the fastening bolts against the edge of the glass panel.

In the region of intersection of the cover frame sections two strips of the supporting foil, coated with the sealing mass at the sides facing the glass panels, superpose one another. Thereby no water stagnation occurs at the outer side of the front wall or roof in the regions of the corners which are formed by the cover frame sections 24 and 29. A drain or outlet gap 49 is provided between cover profiles or frame sections 29, connected to the crossbar profiles 28, and the cover frame sections 24.

In the region of the end surface of the cover frame section 25, by which the drain gap 49 is limited, an opening is available between the sealing strips which are anchored in the cover frame sections. This opening must be closed with a sealing mass.

Figure 6:
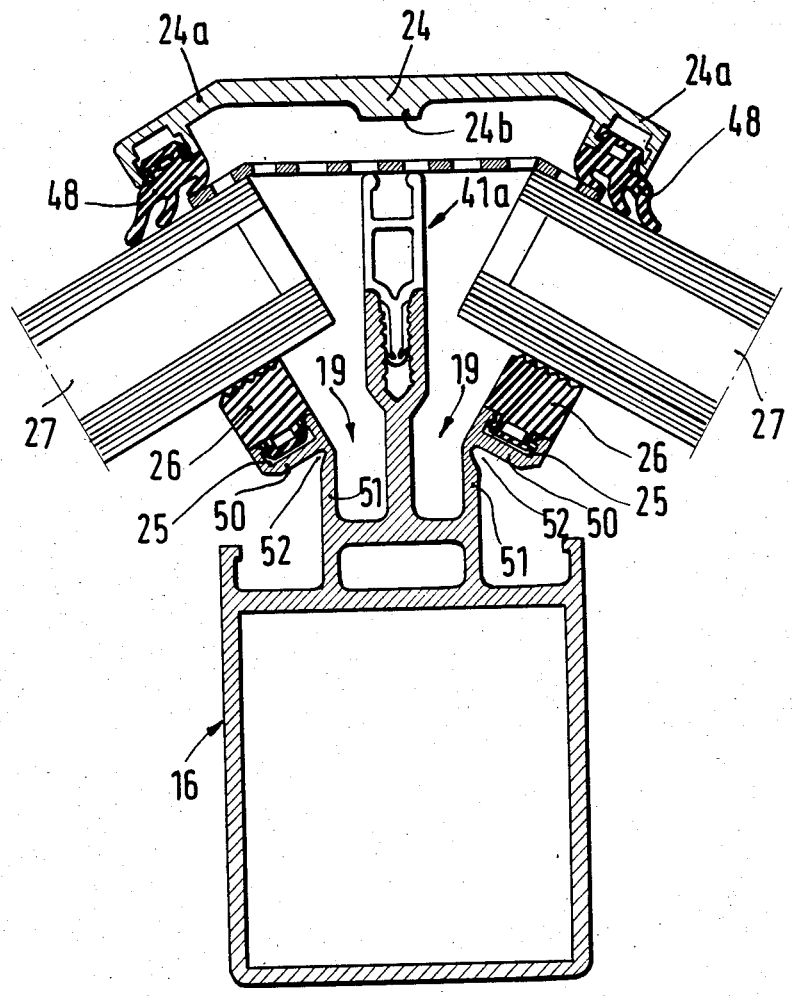
FIG. 6 is a vertical sectional view of the main profile of the front wall or roof, provided with an insulating glass, according to a further embodiment of the invention.
Figure 7:
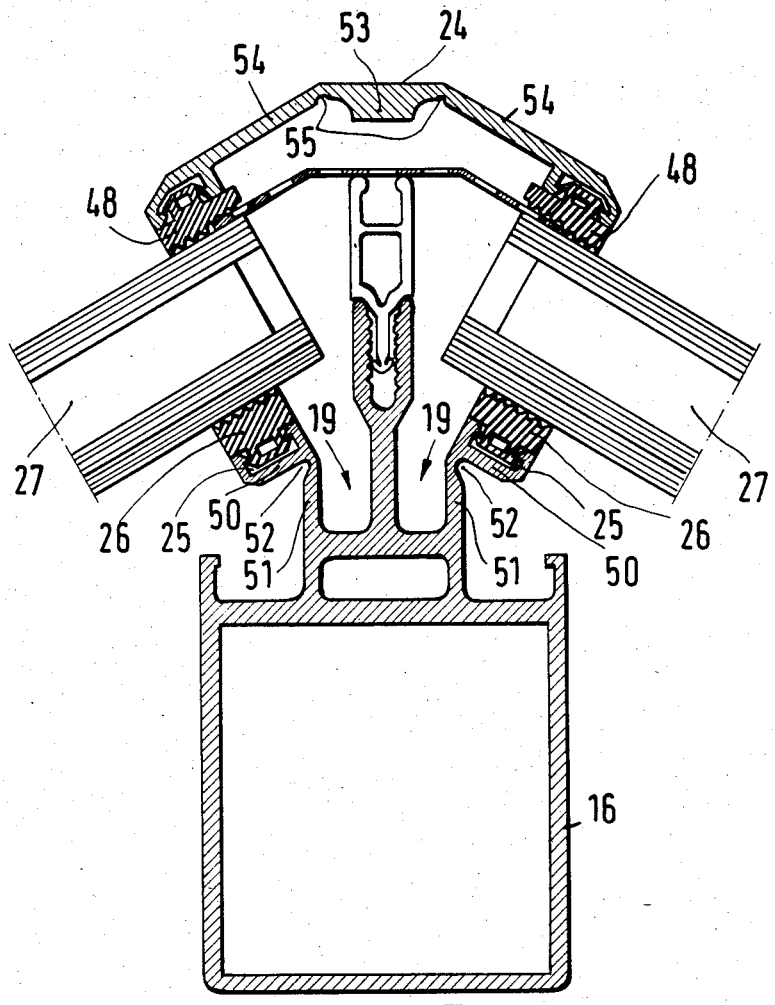
FIG. 7 is a vertical sectional view of yet another embodiment of the invention.
Figure 8:
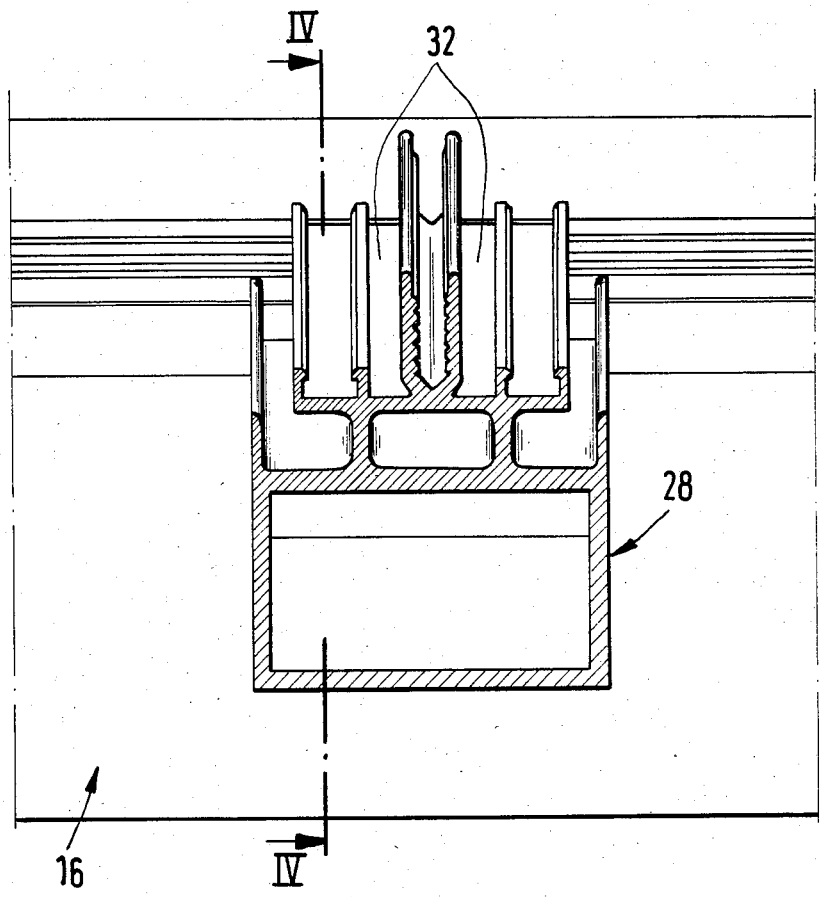
FIG. 8 is a cross-sectional view through a modified crossbar profile.
Figure 9:
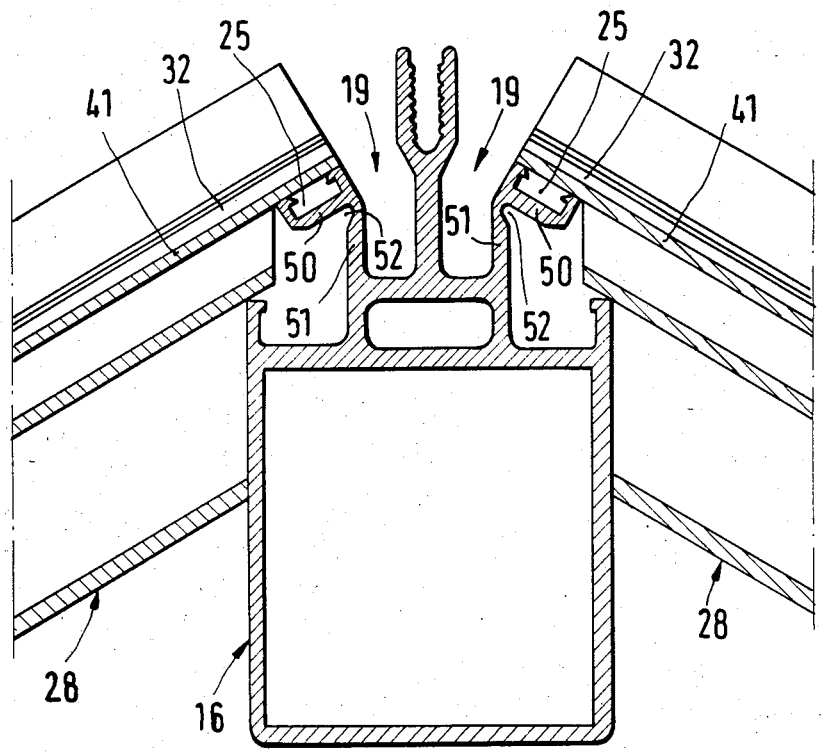
FIG. 9 is a vertical cross-sectional view taken along line IX—IX of FIG. 8 and illustrating the butt joint between two crossbar profiles and the main profile.

Referring now to FIGS. 6 and 7 it will be seen that these figures illustrate sectional views of the main frame section 16 of the metal framework of the front wall or roof, connected to the cover frame section 24, in accordance with two modified embodiments. The main frame section 16 is provided with profiled or shaped portions 50 which form anchoring grooves 25 for receiving portions of the sealing strips 26. Profiled portions 50 are supported by cross-pieces 51. The sealing strips 26 mounted on the anchoring grooves 25 support the glass panels, preferably insulating panes. The cover frame section 24, which in the embodiments of FIGS. 6 and 7 has angularly bent end portions, is provided on the undersides of these portions with the grooves which partially receive and hold sealing strips 48 abutting against the upper faces of glass panels 27. These panels in the embodiments of FIGS. 6 and 7 are inclined relative to the main frame section 16. As seen in FIGS. 8 and 9 the crossbar frame sections 28 are also inclined relative to the main frame section 16.

As shown in FIG. 9 in particular respective profiled portions or extensions 50 of the main frame section, which have anchoring grooves 25 are inclined relative to the respective cross-pieces 51 by the same angle as the crossbar frame sections 28 are inclined to the main frame section 16.

The advantage of the framework structure resides in that the bottom wall 41 of each groove 32 for percolating waters of the crossbar frame section 28 extends up to the upper edge of a respective groove 19 for percolating waters of the main frame section 16. The bottom wall 41 of each crossbar frame section also lies completely snugly on the upper surfaces of the profiled portions or extensions 50 of the main frame section 16.

No problem of non-reliable sealing in the region of the butt occurs in the framework of this invention. In other words a reliable transition between grooves 32 of the crossbar profiles 28 and grooves 19 of the main profile 16 is ensured.

A further advantage of the framework structure of this invention resides in that profiled portions 50 are positioned obliquely relative to the remaining part of the main frame section 16 so that for supporting the glass panels 27 the same sealing strips 26 can be utilized, which are used for the crossbar frame sections 28 extended at right angles to the main frame section 16.

FIGS. 6, 7 and 9 clearly show that the transition zone between each cross-piece 51 and profiled portion 50 is provided with an undercut 52. Bending of the profiled portion 50 relative to the cross-piece 51 is facilitated by such an undercut.

In the embodiment of FIG. 6 the end angular portions **24*a* of the cover frame section 24 are inclined to the horizontal part of the cover frame section at the same angle as the glass panels 27 and the crossbar frame sections 28. The underside of the cover frame section 24 is provided with a central projection or web 24*b*. Sealing strips 48 have downwardly extended spaced tongues abutting against the upper faces of the glass panels 27. Sealing strips 26 have toothed upper surfaces sealingly abutting against the undersides of glass panels 27**.

In the embodiment of FIG. 7 the cover frame section 24 has at the transition zones between a central web or projection 53 and inclined side portions or walls 54 weakening grooves 55 provided on the underside of the cover frame section 24. Due to these weakening grooves it is possible in a simple manner to bend side walls 54 relative to the central web 53 so that these walls would extend parallel to the glass panels 27 and crossbar frame sections 28. Weakening grooves 55 ensure that any desired angle of inclination of walls 54 can be obtained.

It will be understood that each of the elements described above, or two or more together, may also find a useful application in other types of front wall or roof structures differing from the types described above.

While the invention has been illustrated and described as embodied in a front wall or roof structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a metal-glass structure for a front wall or a roof, comprising a metal framework having flats covered with glass panels, said framework including a plurality of main frame sections at a building side, a plurality of crossbar frame sections extending transversely of said main frame sections, and a plurality of cover profiles screwed to said main and crossbar frame sections and extending over edges of said glass panels, said main frame sections, said crossbar frame sections and said cover profiles having anchoring grooves and sealing strips partially received in said anchoring grooves, respectively and supported on the edges of the glass panels, said main and crossbar frame sections each enclosing a hollow chamber and being provided with gutters for condensed water and grooves for percolating water, the improvement comprising each groove (32) for percolating water in each crossbar frame section (28) having a bottom wall (41) which extends up to an upper edge of a respective groove (19) for percolating water of an adjacent main frame section (16) and is supported against said upper edge, each main frame section having two longitudinal grooves being defined by outer profiled wall portions which form the anchoring grooves (25) for receiving first sealing strips (26), each crossbar frame section having at least two anchoring grooves (35) for receiving second sealing strips (36), said two anchoring grooves having the same height as that of said grooves (32) for percolating water, the height of said first sealing strips (26) being greater than that of said second sealing strips, said first and second sealing strips being supported against a common face of a respective glass panel, and said two anchoring grooves (35) for the sealing strips having bottom walls which in a region of overlapping are supported on walls of the anchoring grooves (25) of the adjacent main frame section.

2. The structure as defined in claim 1, wherein each crossbar frame section has a main hollow chamber section (30) and an additional hollow chamber (31) above said main chamber, said additional chamber being positioned between two gutters (37) for condensed water and having a bottom wall (38) being flush with bottom walls (39) of said gutters, said main hollow chamber section being positioned below said gutters for condensed water, the bottom wall (38) of each additional hollow chamber and the bottom walls (39) of said two gutters of each crossbar frame section being supported on an upper longitudinal edge (40) of a respective gutter (20) for condensed water of the adjacent main frame section.

3. The structure as defined in claim 1, wherein the gutters (20) for condensed water of each main frame section each has a bottom wall which is flush with a bottom wall of each groove (19) for percolating water of said main frame section, the bottom walls of said gutters (20) and the bottom walls of said grooves (19) forming an upper wall of a hollow chamber of each main frame section.

4. The structure as defined in claim 3, wherein each main frame section is formed with a central web (21) extended upwardly from the hollow chamber thereof, said web being formed with a threaded opening (22) and defining said two grooves (19) for percolating water.

5. The structure as defined in claim 4, wherein each crossbar frame section is formed with a central profiled portion extended upwardly from said additional hollow chamber and being formed with a threaded opening (33), said central portion defining said two grooves (32) for percolating water.

6. The structure as defined in claim 5, further including profiled strips (41*a*) of plastics each extended between each two adjacent glass panels over the entire width of the glass panel, each profiled strip having a fastening foot projection (42*a*) received in a respective threaded opening (22, 33).

7. The structure as defined in claim 6, wherein said foot projection has locking tongues (43) engaged in said respective threaded opening.

8. The structure as defined in claim 7, wherein a longitudinal gap (49) for water is formed between an end face of a cover profile (29) screwed to a respective crossbar frame section and an end face of a cover profile (24) screwed to a respective main frame section.

9. The structure as defined in claim 8, further including supporting foils (47) each overlapping the edges of adjacent glass panels and being supported between the sealing strips received in the anchoring grooves of each cover profile and said edges of adjacent glass panel, said foils being each coated at a side facing an edge of a respective glass panel with a sealing mass and having a length corresponding to that of a respective cover profile.

10. The structure as defined in claim 8, wherein two supporting foils, superposed one another, are positioned in the region of intersecting of the cover profiles, said supporting foils being each coated with a sealing mass at a side thereof facing a respective glass panel.

11. The structure as defined in claim 8, wherein in the region of said gap an opening in the end face of the cover profile, screwed to a respective crossbar frame section, is closed with a sealing mass.

12. The structure as defined in claim 9, wherein angular shaped sealing strips are provided in each corner region between adjacent frame sections, the sealing strips received in said anchoring grooves being connected with said angular shaped sealing strips.

13. The structure as defined in claim 7, wherein each of said outer profiled portions (50) defining the anchoring groove (25) in said main frame section (16) includes a crosspiece (51) extended upwardly from the hollow chamber of the main frame section, each outer profiled portion (50) being inclined to said crosspiece, each crossbar frame section being also inclined to an adjacent main frame section, the angle of the inclination of the profiled portion to said crosspiece being equal to the angle of inclination of each crossbar frame section to the adjacent main frame section.

14. The structure as defined in claim 13, wherein a transmission zone is provided between each crosspiece and a respective profiled portion, an undercut (52) being provided at said transition zone.

15. The structure as defined in claim 13, wherein the cover profile (24) has a straight portion and angular end portions, said end portion being formed with the anchoring grooves receiving the sealing strips (48), said end portions being inclined to said straight portion at an angle which is equal to the angle of inclination of each crossbar frame section to the adjacent main frame section.

16. The structure as defined in claim 15, wherein the straight portion of the cover profile is provided with a central web (53) at an underside thereof, and wherein weakening grooves (55) are formed between said central web and said angular end portions at said underside.

* * * * *